US011367969B2

(12) United States Patent
Shimada et al.

(10) Patent No.: US 11,367,969 B2
(45) Date of Patent: Jun. 21, 2022

(54) WIRE WITH TERMINAL

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Takanobu Shimada, Mie (JP); Yasuyuki Ono, Mie (JP); Takuya Yamashita, Mie (JP); Ryoji Miyamoto, Mie (JP); Jun Tsurii, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/052,000

(22) PCT Filed: Dec. 5, 2018

(86) PCT No.: PCT/JP2018/044761
§ 371 (c)(1),
(2) Date: Oct. 30, 2020

(87) PCT Pub. No.: WO2019/215949
PCT Pub. Date: Nov. 14, 2019

(65) Prior Publication Data

US 2021/0167524 A1 Jun. 3, 2021

(30) Foreign Application Priority Data

May 10, 2018 (JP) ..... JP2018-091268

(51) Int. Cl.
*H01R 4/18* (2006.01)
*H01R 4/70* (2006.01)
(Continued)

(52) U.S. Cl.
CPC ..... *H01R 4/185* (2013.01); *H01R 4/188* (2013.01); *H01R 4/70* (2013.01); *H01R 13/5216* (2013.01); *H01R 43/048* (2013.01)

(58) Field of Classification Search
CPC ..... H01R 4/185; H01R 4/188; H01R 4/70; H01R 13/5216; H01R 43/048
(Continued)

(56) References Cited

U.S. PATENT DOCUMENTS 7,174,633 B2 * 2/2007 Onuma ..... H01R 4/04 29/854
7,828,612 B2 * 11/2010 Kumakura ..... H01R 4/185 439/877
(Continued)

FOREIGN PATENT DOCUMENTS

JP 2005-251400 A 9/2005
JP 2008-282673 A 11/2008
JP 2017-111945 A 6/2017

OTHER PUBLICATIONS

International Search Report dated Feb. 5, 2019 for WO 2019/215949 A1 (4 pages).

*Primary Examiner* — Peter G Leigh
(74) *Attorney, Agent, or Firm* — Abelman, Frayne & Schwab

(57) ABSTRACT

A wire with terminal WT1 is provided with a wire 2 including a core 2B and an insulation coating 2C covering around the core 2B, and a terminal 1 including a coating crimping portion 50 crimped to the insulation coating 2C. The wire 2 is pulled out rearward from the terminal 1. A water cut-off member 60 for suppressing liquid intrusion
(Continued)

into the core 2B is disposed between an inner peripheral surface 20A of the coating crimping portion 50 and an outer peripheral surface 2A of the insulation coating 2C. The coating crimping portion 50 is provided with an oblique extending portion 70 for reducing the outflow of the water cut-off member 60 to outside due to crimping.

8 Claims, 10 Drawing Sheets

(51) Int. Cl.
*H01R 13/52* (2006.01)
*H01R 43/048* (2006.01)

(58) Field of Classification Search
USPC ..... 439/877
See application file for complete search history.

(56) References Cited

U.S. PATENT DOCUMENTS 8,251,759 B2 * 8/2012 Matsunaga ..... H01R 43/055 439/885
8,870,611 B2 * 10/2014 Sato ..... H01R 4/188 439/877
8,974,258 B2 * 3/2015 Mitose ..... H01R 4/70 439/877
9,039,467 B2 * 5/2015 Seipel ..... H01R 4/20 439/877
9,502,785 B2 * 11/2016 Schmidt ..... H01R 4/183
9,543,689 B2 * 1/2017 Sato ..... H01R 4/188
9,640,877 B2 * 5/2017 Aoki ..... H01R 4/185
9,774,099 B2 * 9/2017 Aoki ..... H01R 4/70
9,774,101 B2 9/2017 Yoshida et al.
9,780,462 B2 * 10/2017 Nakata ..... H01R 4/185
9,787,005 B2 * 10/2017 Bluemmel ..... H01R 4/18
9,847,596 B2 * 12/2017 Sato ..... H01R 13/5216
10,573,978 B2 2/2020 Sato et al.
2015/0357722 A1 * 12/2015 Sato ..... H01R 4/185 439/877
2016/0359251 A1 * 12/2016 Droesbeke ..... H01R 13/113
2017/0005417 A1 1/2017 Aoki et al.
2017/0179619 A1 1/2017 Nakata et al.
2017/0324184 A1 * 11/2017 Lehner ..... H01R 4/185
2017/0346198 A1 * 11/2017 Chadbourne ..... H01R 43/048
2018/0109009 A1 * 4/2018 Saito ..... H01R 4/18
2018/0109010 A1 * 4/2018 Takahashi ..... H01R 4/183

* cited by examiner

WIRE WITH TERMINAL

CROSS REFERENCE TO RELATED APPLICATIONS

This application is a national phase of PCT application No. PCT/JP2018/044761, filed on 5 Dec. 2018, which claims priority from Japanese patent application No. 2018-091268, filed on 10 May 2018, all of which are incorporated herein by reference.

TECHNICAL FIELD

A technique disclosed by this specification relates to a wire with terminal and particularly to a waterproof structure in a terminal.

BACKGROUND

Conventionally, a wire with terminal having a waterproof structure applied to a terminal is, for example, known from Patent Document 1. In this crimping terminal, a wire connecting portion includes a first barrel piece and a second barrel piece extending on both ends of a bottom portion, an end part of a wire is wound by the first barrel piece, and the end part of the wire and the first barrel piece are wound by the second barrel piece to crimp the wire connecting portion to the end part of the wire. Further, a water cut-off member is stuck to inner wall surfaces of the bottom portion, the first barrel piece and the second barrel piece, and this water cut-off member forms a water cut-off region between the inner wall surface of the wire connecting portion and the wire after crimping is completed. In this way, water intrusion into between the wire connecting portion and a core on a tip is prevented.

PRIOR ART DOCUMENT

Patent Document

Patent Document 1: JP 2017-111941A

SUMMARY OF THE INVENTION

Problems to be Solved

However, in this technique, there is a concern that the water cut-off member is pushed out from an end of a terminal connecting portion by a tightening force in crimping the first and second barrel pieces and water intrudes into the inside of the terminal connecting portion.

Means to Solve the Problem

A wire with terminal according to the technique disclosed in this specification is provided with a wire including a core and an insulation coating covering around the core, and a terminal including a coating crimping portion crimped to the insulation coating, wherein the wire is pulled out rearward from the terminal, a water cut-off member for suppressing liquid intrusion into the core is disposed between an inner peripheral surface of the coating crimping portion and an outer peripheral surface of the insulation coating, and the coating crimping portion is provided with an oblique extending portion for reducing rearward outflow of the water cut-off member due to the crimping.

In the wire with terminal in which the coating crimping portion is crimped to the insulation coating, there is a concern that the water cut-off member is pushed out rearward from between the inner peripheral surface of the coating crimping portion and the outer peripheral surface of the insulation coating in crimping the coating crimping portion to the insulation coating. In contrast, according to the above configuration, the outflow of the water cut-off member to outside is reduced by the oblique extending portion, wherefore water intrusion into the coating crimping portion from behind can be prevented.

The following configurations are preferable as embodiments relating to the technique disclosed in this specification.

The coating crimping portion includes a bottom portion having the insulation coating placed thereon, a first barrel piece extending from one side end of the bottom portion and a second barrel piece extending longer than the first barrel piece from another side end of the bottom portion, and the inner peripheral surface of the coating crimping portion is closed over an entire circumference by the second barrel piece winding around the outer peripheral surface of the wire and the first barrel piece.

Accordingly, for example, as compared to the case where the inner peripheral surface of the coating crimping portion is not closed over the entire circumference, the water cut-off member is easily pushed out rearward from between the inner peripheral surface of the coating crimping portion and the outer peripheral surface of the insulation coating in crimping the coating crimping portion to the insulation coating, but the outflow of the water cut-off member to outside can be reduced by the oblique extending portion. Specifically, a configuration based on the oblique extending portion is very effective when the inner peripheral surface of the coating crimping portion is closed over the entire circumference by the second barrel piece winding around the outer peripheral surface of the insulation coating and the first barrel piece as in this configuration.

The coating crimping portion includes a ceiling portion formed at a position facing the bottom portion via the wire by overlapping the first and second barrel pieces, and the oblique extending portion is provided behind the bottom portion.

In crimping the coating crimping portion to the insulation coating, clearances are formed between the first and second barrel pieces and between the second barrel piece and the wire on the side of the ceiling portion of the coating crimping portion, but clearances are hardly formed on the side of the bottom portion and the water cut-out member is easily pushed out rearward from the coating crimping portion. In contrast, since the water cut-out member remains on the oblique extending portion provided behind the bottom portion of the coating crimping portion according to the above configuration, a water cut-off effect on the side of the bottom portion can be enhanced on a back surface side of the coating crimping portion.

Further, a mold composed of an upper mold and a lower mold is generally used to crimp the coating crimping portion to the insulation coating. In crimping, the oblique extending portion has only to be placed to project from the rear end of the lower mold. Thus, the oblique extending portion is easily positioned with respect to the mold and hardly displaced during crimping.

The oblique extending portion is inclined in a diameter expanding direction toward a rear side. Specifically, by providing the oblique extending portion extending rearward while being inclined in the direction to expand a diameter of the coating crimping portion in a rear end part of the coating crimping portion, a space can be formed between the insulation coating and the oblique extending portion and the water cut-off member can easily remain in this space.

The terminal further includes a rear extending portion connected to a rear end of the coating crimping portion over an entire circumference and configured to surround the insulation coating, and the oblique extending portion constitutes the rear extending portion.

According to this configuration, since the water cut-off member pushed out rearward from the coating crimping portion is accommodated between the rear extending portion and the insulation coating over the entire circumference, the water cut-off effect on the back surface side of the coating crimping portion can be enhanced. Further, since a water intrusion path into the coating crimping portion is closed from the back surface side by the rear extending portion, the insulation coating can be tightened without considering an influence on the water cut-off member in the coating crimping portion.

A parallel extending portion is further provided which is connected to a rear end of the rear extending portion over an entire circumference, extends rearward and surrounds the insulation coating, and a ceiling portion and a bottom portion of the parallel extending portion extend in parallel to the insulation coating.

According to this configuration, since a part of the water cut-off member that cannot be accommodated in the rear extending portion remains on the parallel extending portion, the water cut-off effect on the back surface side of the coating crimping portion can be enhanced. Further, since the bottom portion of the rear extending portion extends in parallel to the insulation coating, the water cut-off member hardly hangs down from the rear end of the rear extending portion.

Effect of the Invention

According to the wire with terminal according to the technique disclosed in this specification, it is possible to enhance the water cut-off effect in the terminal.

DETAILED DESCRIPTION TO EXECUTE THE INVENTION

First Embodiment

A first embodiment is described with reference to FIGS. 1 to 8.

Figure 1:
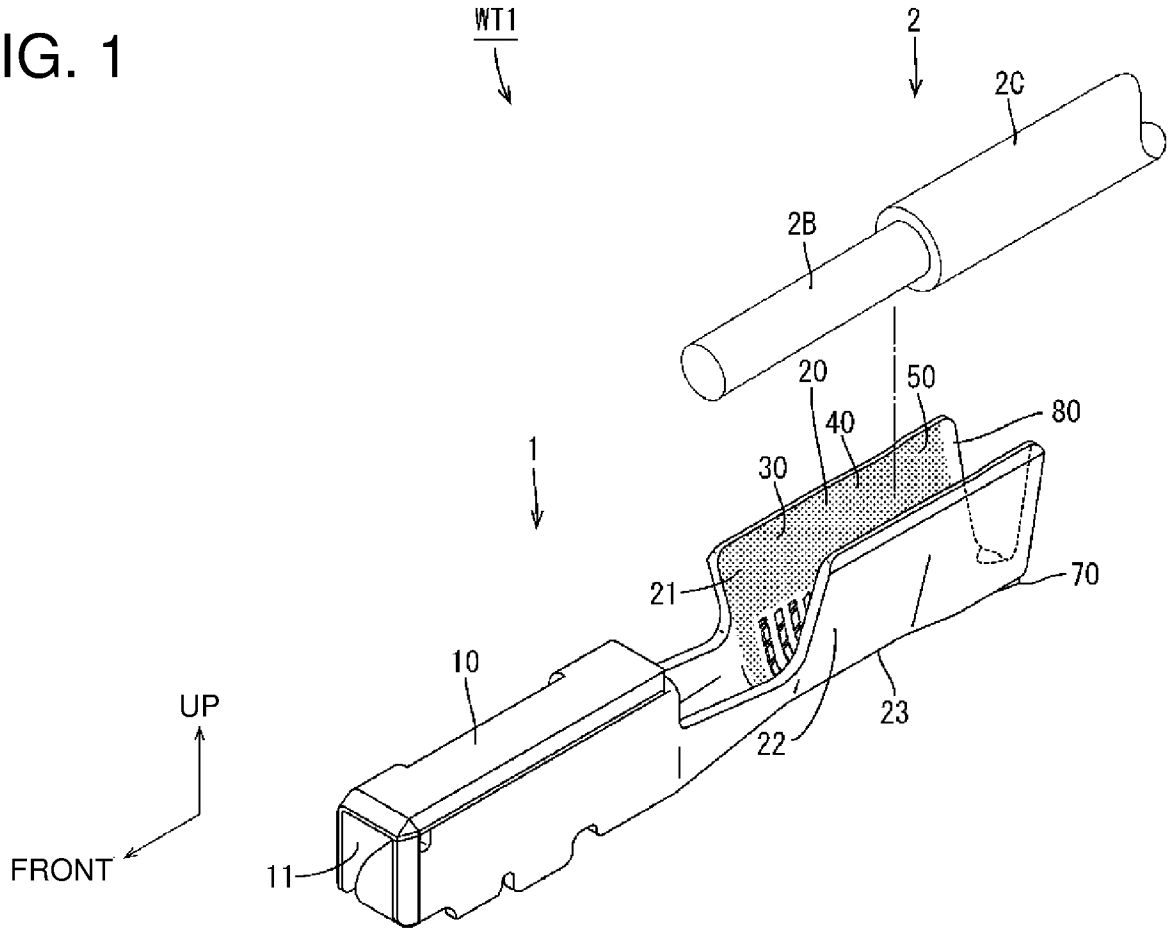
FIG. 1 is a perspective view of a wire and a terminal before crimping in a wire with terminal of a first embodiment when viewed obliquely from front.

This embodiment relates to a wire with terminal WT1 including a female terminal 1 to be connected to a mating terminal and a wire 2 connected to the terminal 1. The wire 2 is a coated wire including a core 2B and an insulation coating 2C covering around the core 2B, and the core 2B is exposed at an end of the wire 2. As shown in FIG. 1, the terminal 1 includes a terminal contact portion 10 having an opening 11 for receiving the mating terminal fitting, and a wire connecting portion 20 to be connected to the end of the wire 2. In the following description, a vertical direction is based on FIG. 1 and a side toward which the wire 2 is pulled out from the wire connecting portion 20 (right side in FIG. 3) is referred to as a rear side.

As shown in FIG. 1, the wire connecting portion 20 is open upward as a whole in a state before the wire 2 is connected. The wire connecting portion 20 includes a core crimping portion 30, a coupling portion 40 connected to the rear end of the core crimping portion 30 over an entire width, a coating crimping portion 50 connected to the rear end of the coupling portion 40 over an entire width and a rear extending portion 80 connected to the rear end of the coating crimping portion 50 over an entire width and constituting a rear end part of the wire connecting portion 20. A bottom portion 23 of the wire connecting portion 20 is provided in common to the core crimping portion 30, the coupling portion 40 and the coating crimping portion 50, and a sawtooth-like serration portion 31 is formed in the upper surface of the core crimping portion 30. The bottom portion 23 of the rear extending portion 80 is formed with an oblique extending portion 70 extending rearward while being inclined downward from the bottom portion 23 of the coating crimping portion 50. In other words, the oblique extending portion 70 constituting the rear extending portion 80 is provided in a rear end part of the coating crimping portion 50. In the following description, out of the wire connecting portion 20, a part extending obliquely upward from one side end of the bottom portion 23 is referred to as a first barrel piece 21 and a part extending obliquely upward from the other side end of the bottom portion 23 is referred to as a second barrel piece 22. An extending dimension of the second barrel piece 22 from the bottom portion 23 is larger than that of the first barrel piece 21 from the bottom portion 23.

Figure 2:
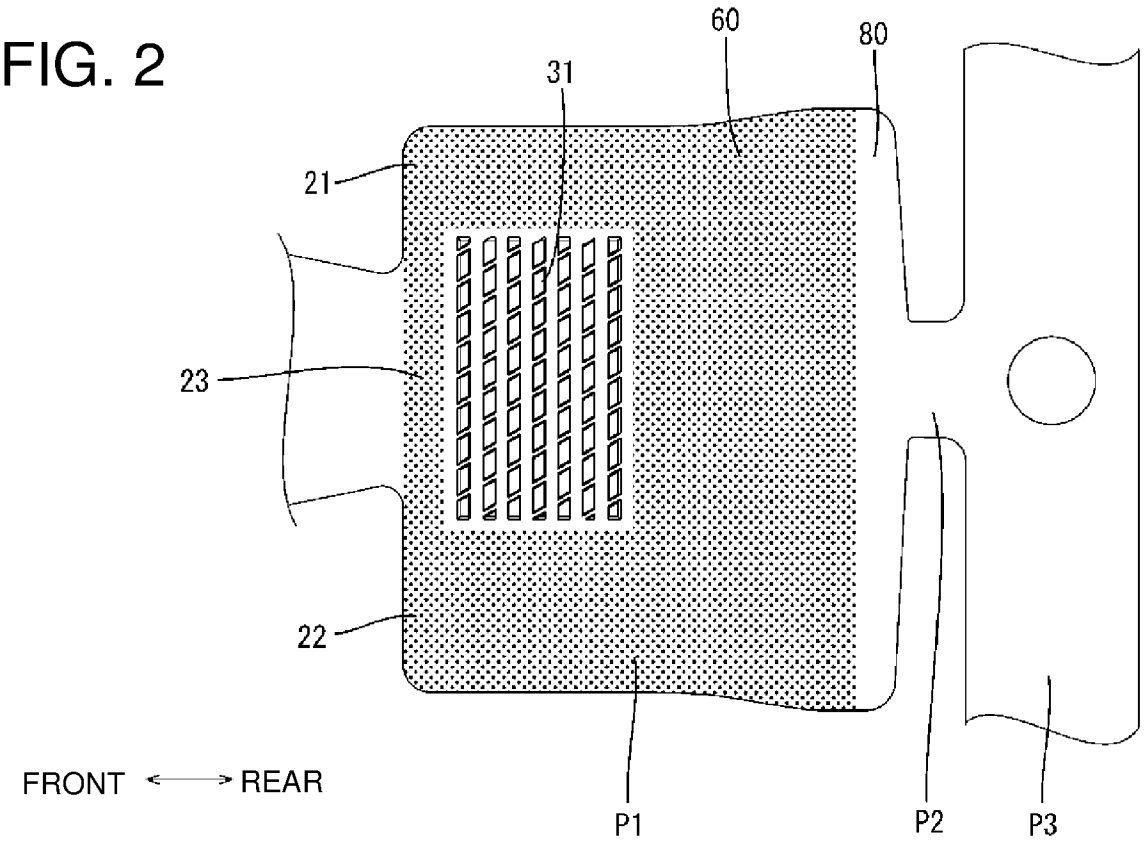
FIG. 2 is a top view showing a base material constituting a wire connecting portion.

The wire connecting portion 20 is formed to be open upward as shown in FIG. 1 from a plate-like base material P1 connected to a carrier P3 via a bridge P2 particularly as shown in FIG. 2. A water cut-off member 60 is stuck to a part of the upper surface of the base material P1 except the serration portion 31 and the rear extending portion 80.

In forming the wire connecting portion 20 shaped to be open upward as shown in FIG. 1 from the base material P1, the bottom portion 23 is formed into an arcuate shape corresponding to an outer peripheral surface 2A of the wire 2 by bending and the first and second barrel pieces 21, 22 are respectively caused to rise obliquely upward. Further, by gripping the bridge P2 by an unillustrated gripping means and displacing the gripped bridge P2 relatively downward with respect to the base material P1, a rear end part of the bottom portion 23 (i.e. the bottom portion 23 of the rear extending portion 80) is stretched downward to form the oblique extending portion 70. Further, by displacing the bridge P2 downward, the gripped bridge P2 and the base material P1 are sheared from each other. In this way, the wire connecting portion 20 separated from the carrier P3 is formed. Note that, in this embodiment, the rear end of the oblique extending portion 70 is formed into a horizontal and substantially flat shape as shown in FIG. 5 by gripping the bridge P2 over an entire width by the unillustrated gripping means and relatively displacing the gripped bridge P2 vertically downward.

Figure 3:
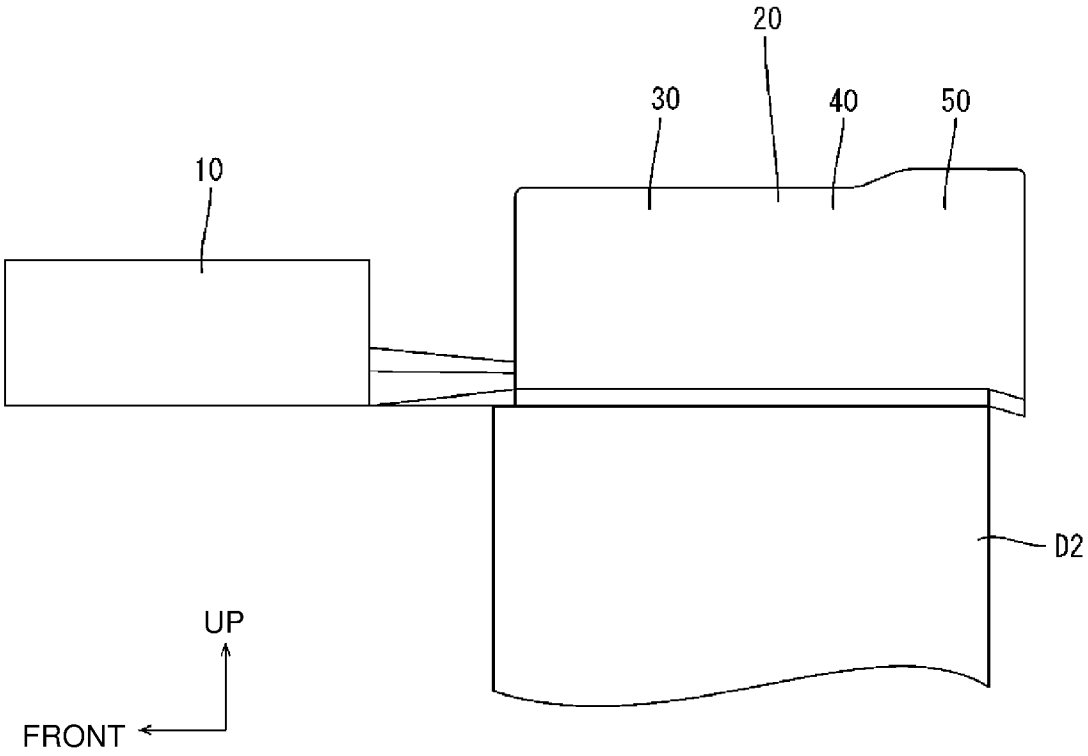
FIG. 3 is a side view showing a state where the wire connecting portion is placed on a lower mold.
Figure 4:
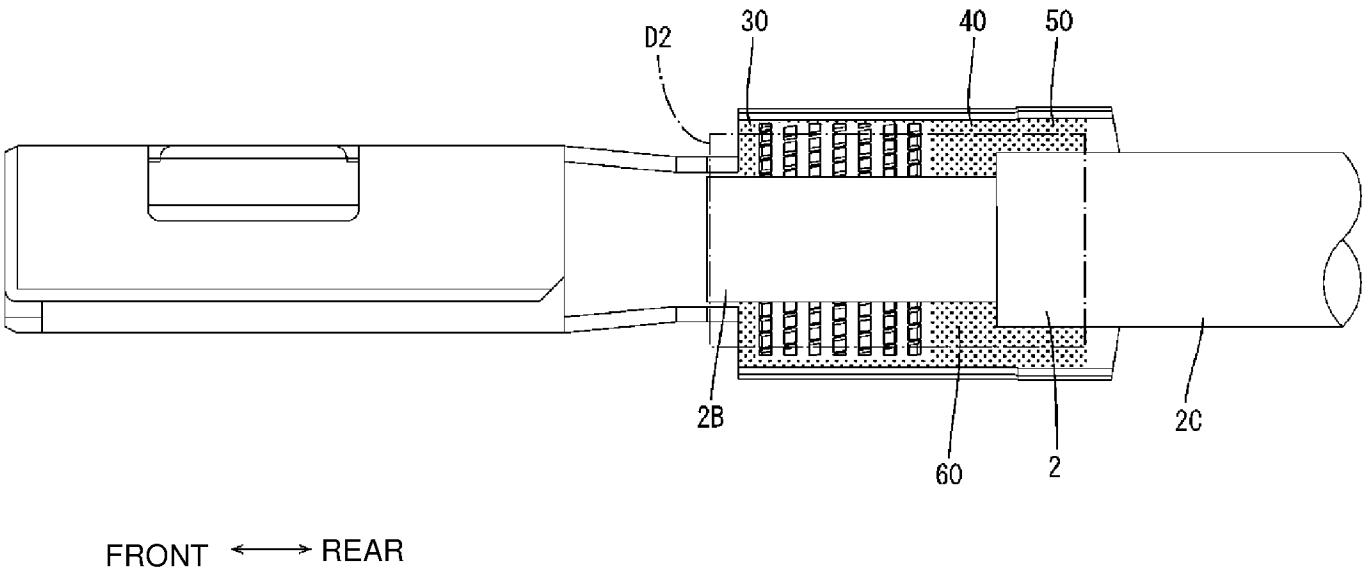
FIG. 4 is a top view showing a state where a wire is placed in the wire connecting portion.

In successively crimping the thus formed wire connecting portion 20 to the wire 2, a mold composed of an upper mold D1 and a lower mold D2 is used. First, as shown in FIG. 3, the wire connecting portion 20 is placed on the upper surface of the lower mold D2. At this time, the front end of the oblique extending portion 70 is arranged in alignment with the rear end of the upper surface of the lower mold D2 and the core crimping portion 30 and the coating crimping portion 50 are placed at proper positions in a front-rear direction with respect to the lower mold D2. When the core 2B and the insulation coating 2C are respectively placed on the upper surfaces of the core crimping portion 30 and the coating crimping portion 50 as shown in FIG. 4, the insulation coating 2C extending rearward from the rear end of the coating crimping portion 50 forms a space C between the insulation coating 2C and the oblique extending portion 70 extending rearward while being inclined in a direction to expand a diameter of the coating crimping portion 50 as shown in FIG. 5.

Figure 5:
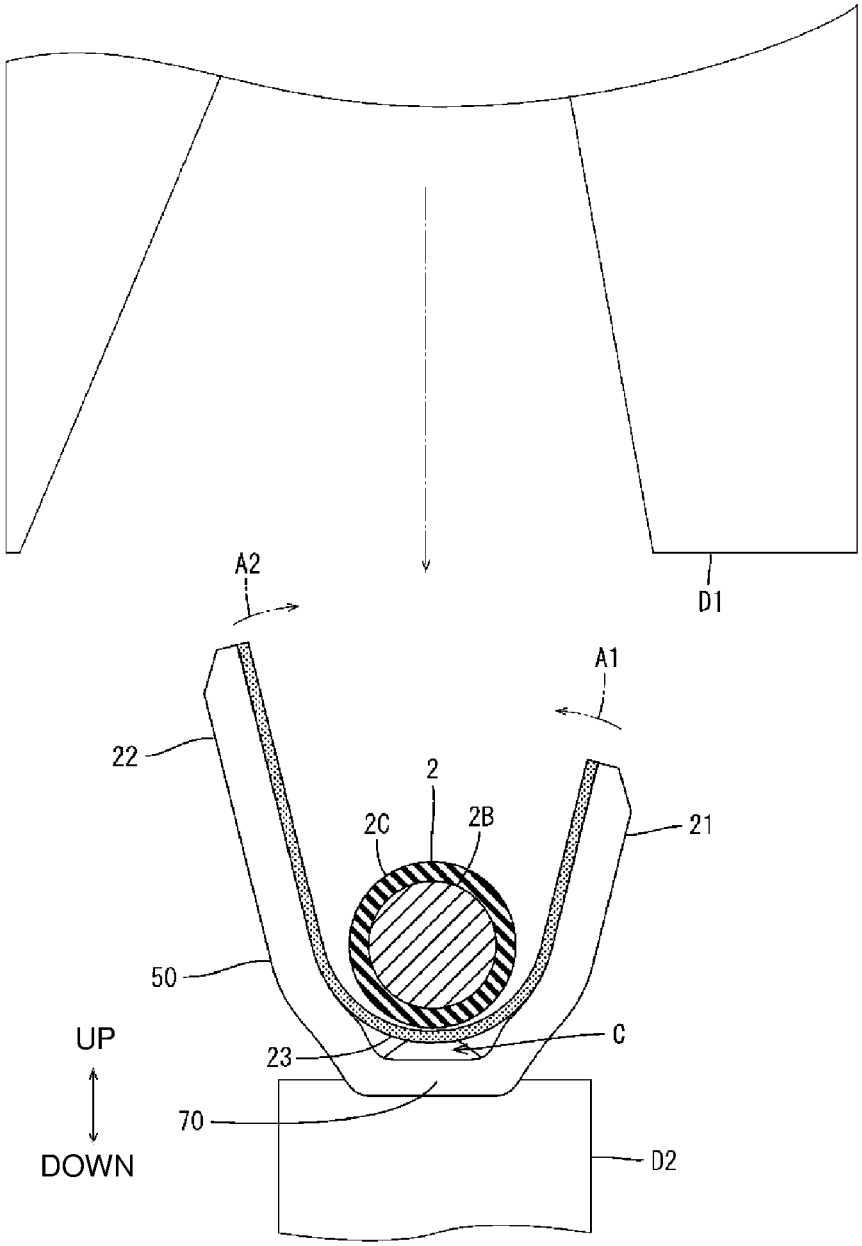
FIG. 5 is a back view showing the state where the wire is placed in the wire connecting portion.

As shown in FIG. 5, the upper mold D1 is put to the wire connecting portion 20 from above and lowered toward the lower mold D2. Then, the first barrel piece 21 is gradually tilted in a direction of an arrow A1 and pressed against the wire 2 and the second barrel piece 22 is gradually tilted in a direction of an arrow A2 and pressed against the wire 2 and the first barrel piece 21. In this way, the wire 2 is pressed against the bottom portion 23 and a part of the water cut-off member 60 stuck to the bottom portion 23 is pushed out into the space C. The water cut-off member 60 pushed out into the space C remains on the oblique extending portion 70.

When the upper mold D1 is lowered, the first and second barrel pieces 21, 22 are wound on the outer peripheral surface 2A of the wire 2 via the water cut-off member 60 stuck to the upper surfaces thereof. In this way, an inner peripheral surface 20A closed over an entire circumference from the front end of the core crimping portion 30 to the rear end of the coating crimping portion 50 is formed.

When the upper mold D1 is further lowered, the first and second barrel pieces 21, 22 are tightened to the wire 2 while further pushing out the water cut-off member 60 into an annular space formed between the inner peripheral surface 20A of the rear extending portion 80 and the outer peripheral surface 2A of the wire 2, whereby a crimped state is completed.

Figure 6:
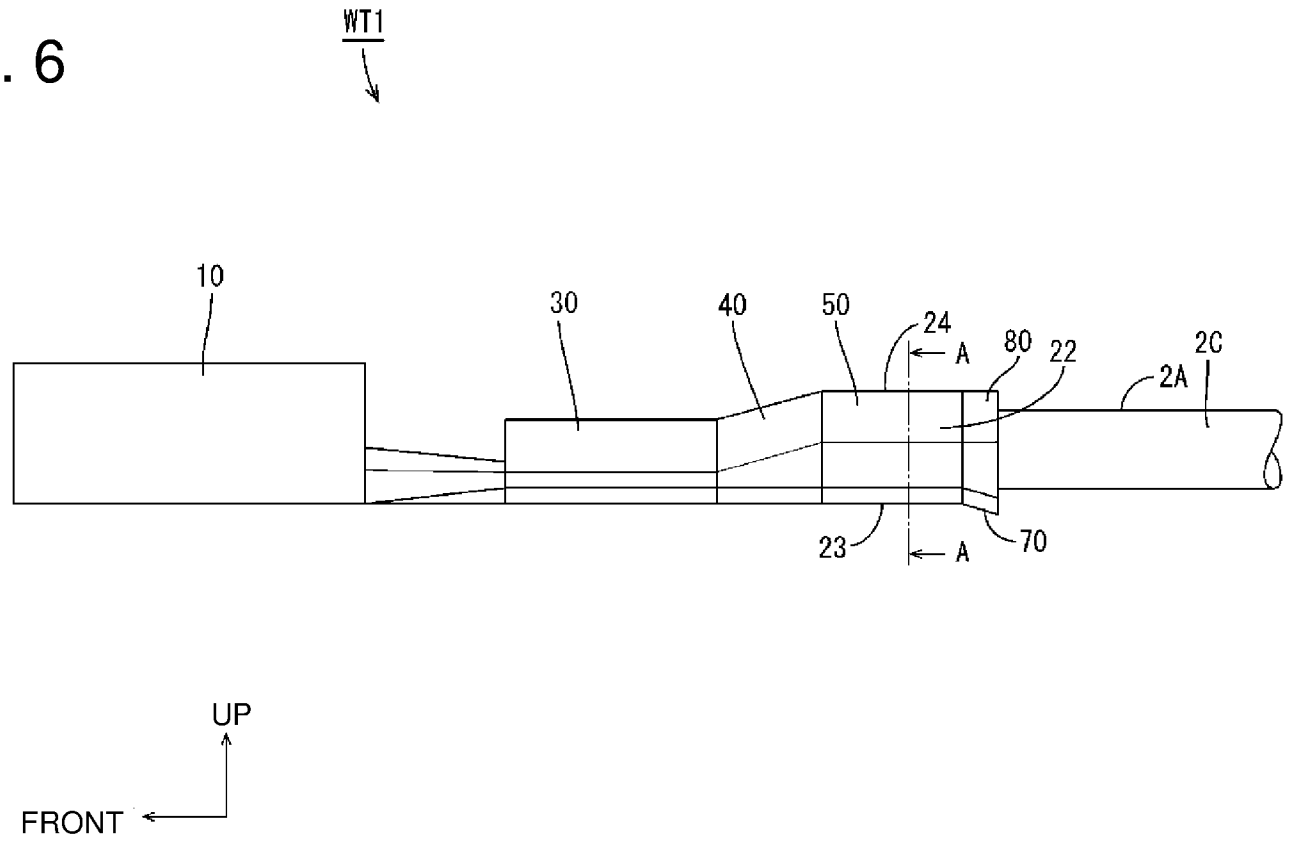
FIG. 6 is side view showing the wire with terminal after crimping.
Figure 7:
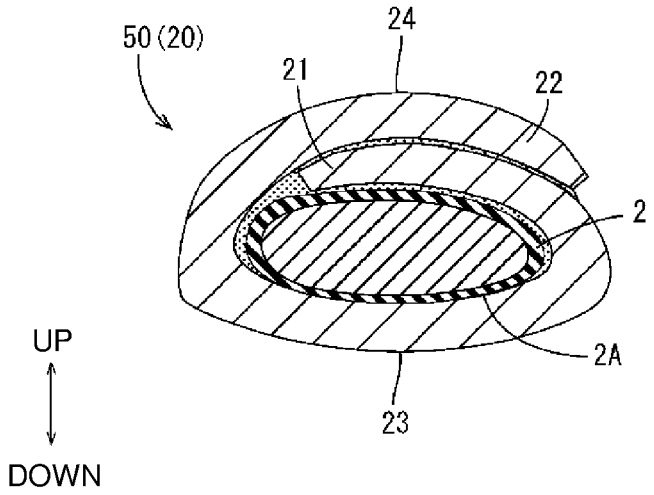
FIG. 7 is a schematic section along A-A of FIG. 6.

With the crimping of the wire 2 completed, the first and second barrel pieces 21, 22 overlap each other from the front end to the rear end of the wire connecting portion 20, whereby a ceiling portion 24 of the wire connecting portion 20 is formed at a position facing the bottom portion 23 via the wire 2 as shown in FIGS. 6 and 7. The water cut-off member 60 is interposed from the front end to the rear end of the wire connecting portion 20 between the outer peripheral surface of the first barrel piece 21 and the inner peripheral surface of the second barrel piece 22 and closes a water intrusion path from the outer peripheral surface of the wire connecting portion 20.

Figure 8:
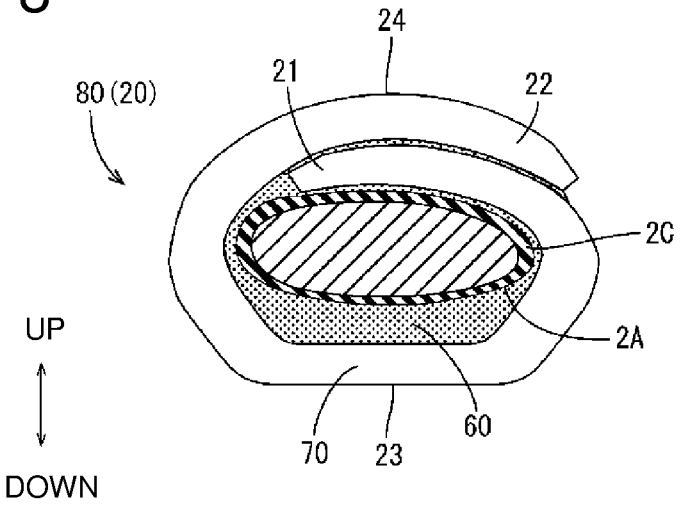
FIG. 8 is a back view showing the terminal after crimping.

Further, on a back surface side of the wire connecting portion 20, the oblique extending portion 70 having an inner surface side separated from the outer peripheral surface 2A of the insulation coating 2C and having a flat shape in a back view is formed as shown in FIG. 8, and the water cut-off member 60 is interposed over the entire circumference between the inner peripheral surface 20A of the rear extending portion 80 and the outer peripheral surface 2A of the insulation coating 2C to close the water intrusion path into the core 2B. Thus, in the coating crimping portion 50, the water intrusion path from the back surface side needs not be considered. For example, as shown in FIG. 7, the insulation coating 2C may be in contact with the bottom portion 23 and the water cut-off member 60 may not be interposed therebetween. In this way, in the coating crimping portion 50, the insulation coating 2C can be tightened to such an extent as not to damage the insulation coating 2C without considering an influence on the water cut-off member 60.

According to the configuration of this embodiment, the wire with terminal WT1 includes the wire 2 having the core 2B and the insulation coating 2C covering around the core 2B and the terminal 1 having the coating crimping portion 50 crimped to the insulation coating 2C, the wire 2 is pulled out rearward from the terminal 1, the water cut-off member 60 for suppressing the intrusion of liquid into the core 2B is disposed between the inner peripheral surface 20A of the coating crimping portion 50 and the outer peripheral surface 2A of the insulation coating 2C, and the coating crimping portion 50 is provided with the oblique extending portion 70 for reducing rearward outflow of the water cut-off member 60 due to crimping.

In the wire with terminal WT1 in which the coating crimping portion 50 is crimped to the insulation coating 2C, there is a concern that, in crimping the coating crimping portion 50 to the insulation coating 2C, the water cut-off member 60 is pushed out in a pull-out direction of the wire 2 from between the inner peripheral surface 20A of the coating crimping portion 50 and the outer peripheral surface 2A of the insulation coating 2C. In contrast, according to the above configuration, the outflow of the water cut-off member 60 to outside is reduced by the oblique extending portion 70, wherefore water intrusion into the coating crimping portion 50 from behind can be prevented.

The coating crimping portion 50 includes the bottom portion 23 having the insulation coating 2C placed thereon, the first barrel piece 21 extending from one side end of the bottom portion 23 and the second barrel piece 22 extending longer than the first barrel piece 21 from the other side end of the bottom portion 23, and the inner peripheral surface 20A of the coating crimping portion 50 is closed over the entire circumference by the second barrel piece 22 winding around the outer peripheral surface 2A of the insulation coating 2C and the first barrel piece 21.

The inner peripheral surface 20A of the coating crimping portion 50 is closed over the entire circumference by the second barrel piece 22 winding around the outer peripheral surface of the insulation coating 2C and the first barrel piece 21. That is, for example, as compared to the case where the inner peripheral surface 20A of the coating crimping portion 50 is not closed over the entire circumference, the water cut-out member 60 is pushed out more rearward from between the inner peripheral surface 20A of the coating crimping portion 50 and the outer peripheral surface 2A of the insulation coating 2C in crimping the coating crimping portion 50 to the insulation coating 2C, but the outflow of the water cut-out member to outside can be reduced by the oblique extending portion 70. Specifically, a configuration based on the oblique extending portion 70 is very effective when the inner peripheral surface 20A of the coating crimping portion 50 is closed over the entire circumference by the second barrel piece 22 winding around the outer peripheral surface of the insulation coating 2C and the first barrel piece 21 as in this embodiment.

The coating crimping portion 50 includes the ceiling portion 24 formed at the position facing the bottom portion 23 via the wire 2 by overlapping the first and second barrel pieces 21, 22, and the oblique extending portion 70 is provided behind the bottom portion 23.

In crimping the coating crimping portion 50 to the insulation coating 2C, clearances are formed between the first and second barrel pieces 21 and 22 and between the second barrel piece 22 and the wire 2 on the side of the ceiling portion 24 of the coating crimping portion 50, but clearances are hardly formed on the side of the bottom portion 23 and the water cut-out member 60 is easily pushed out rearward from the coating crimping portion 50. In contrast, since the water cut-out member 60 remains on the oblique extending portion 70 provided behind the bottom portion 23 of the coating crimping portion 50 according to the above configuration, a water cut-off effect on the side of the bottom portion 23 can be enhanced on the back surface side of the coating crimping portion 50.

The oblique extending portion 70 is inclined in a diameter expanding direction toward the rear side.

Specifically, by providing the oblique extending portion 70 extending rearward while being inclined in the direction to expand the diameter of the coating crimping portion 50 on the rear end part of the coating crimping portion 50, the space C can be formed between the insulation coating 2C and the oblique extending portion 70 and the water cut-out member 60 can easily remain in this space C.

Further, the mold composed of the upper mold D1 and the lower mold D2 is generally used to crimp the coating crimping portion 50 to the insulation coating 2C. In crimping, the oblique extending portion 70 has only to be placed to project from the rear end of the lower mold D2. Thus, the oblique extending portion 70 is easily positioned with respect to the mold and hardly displaced during crimping.

The terminal 1 further includes the rear extending portion 80 connected to the rear end of the coating crimping portion 50 over the entire circumference and configured to surround the insulation coating 2C, and the oblique extending portion 70 constitutes the rear extending portion 80.

According to this configuration, since the water cut-out member 60 pushed out rearward from the coating crimping portion 50 is accommodated between the rear extending portion 80 and the insulation coating 2C over the entire circumference, the water cut-off effect on the back surface side of the coating crimping portion 50 can be enhanced. Further, since the water intrusion path into the coating crimping portion 50 from the back surface side is closed by the rear extending portion 80, the insulation coating 2C can be tightened without considering an influence on the water cut-out member 60 in the coating crimping portion 50.

Second Embodiment

Figure 9:
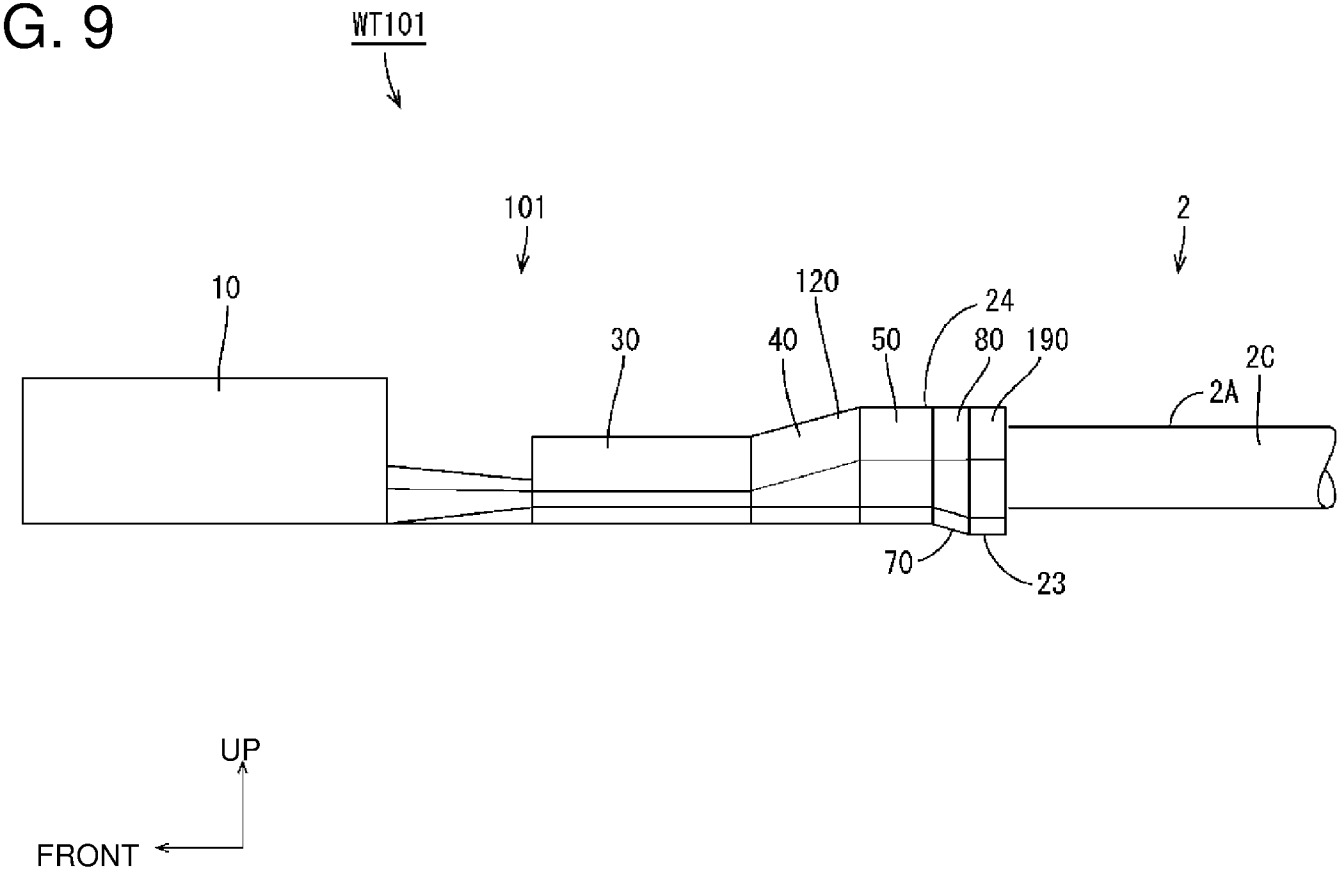
FIG. 9 is a side view showing a wire with terminal after crimping of a second embodiment.

Next, a second embodiment is described with reference to FIG. 9. A wire with terminal WT101 of this embodiment differs from the wire with terminal of the first embodiment in that a parallel extending portion 190 is further provided in addition to a rear extending portion 80 as a rear end part of a wire connecting portion 120 of a terminal 101. In this embodiment, components corresponding to those of the first embodiment are denoted by reference signs obtained by adding 100 to the reference signs of the first embodiment. The same configuration, functions and effects as those of the first embodiment are not described and the same components as those of the first embodiment are denoted by the same reference signs.

The parallel extending portion 190 has a tubular shape connected to the rear end of the rear extending portion 80 over an entire circumference. A wire 2 extending rearward from the rear extending portion 80 is surrounded by the parallel extending portion 190. A ceiling portion 24 of the parallel extending portion 190 is connected to a ceiling portion 24 of the rear extending portion 80 and extends rearward in parallel to an insulation coating 2C. A bottom portion 23 of the parallel extending portion 190 is connected to a bottom portion 23 (i.e. oblique extending portion 70) of the rear extending portion 80 and extends rearward in parallel to the insulation coating 2C.

According to this configuration, since a part of a water cut-off member 60 that cannot be accommodated in the rear extending portion 80 remains in the parallel extending portion 190, the water cut-off effect on a back surface side of the wire connecting portion 120 can be enhanced. Further, since the bottom portion 23 of the parallel extending portion 190 extends in parallel to the insulation coating 2C, the water cut-off member 60 hardly hangs down.

Third Embodiment

Figure 10:
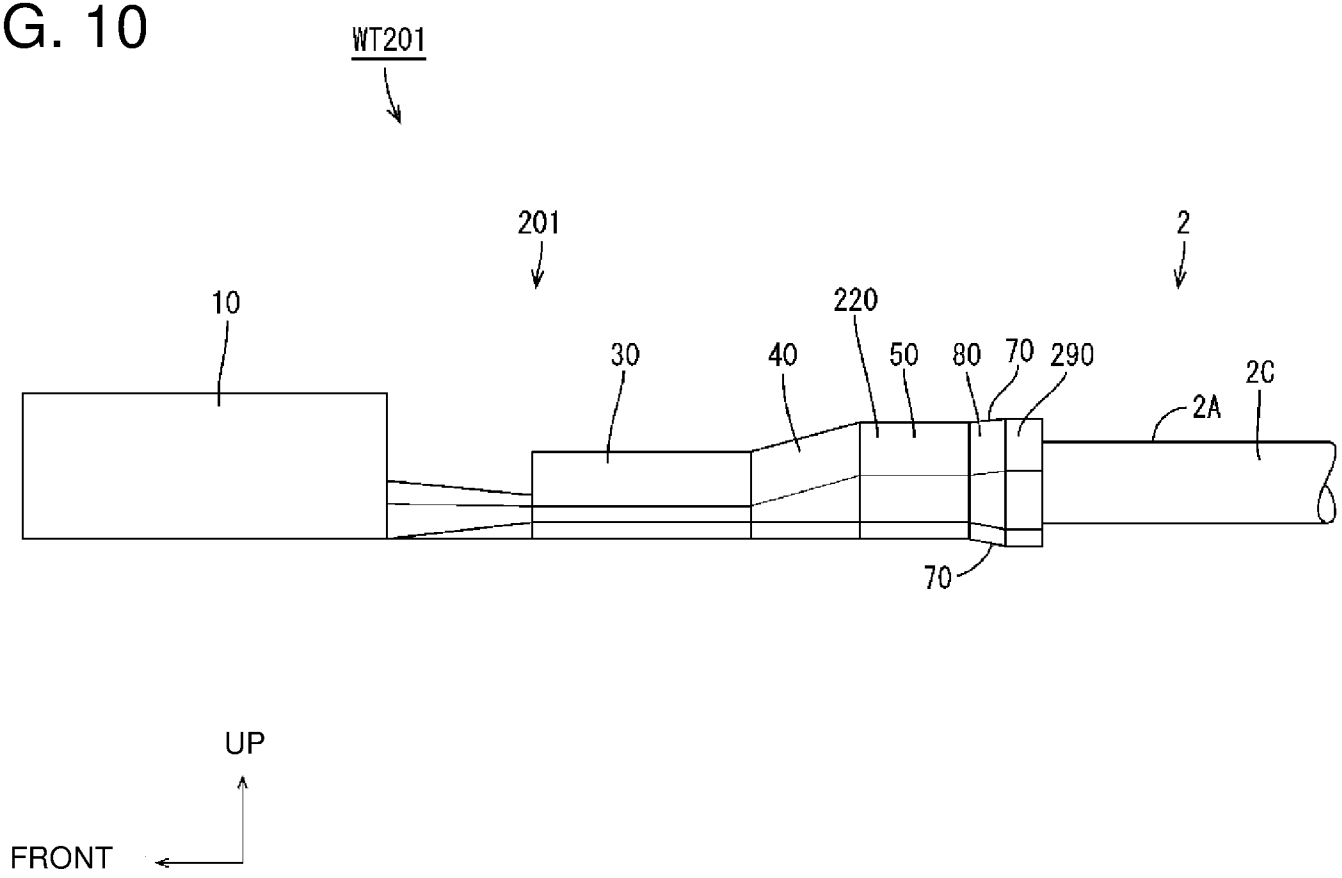
FIG. 10 is a side view showing a wire with terminal after crimping of a third embodiment.

Next, a third embodiment is described with reference to FIG. 10. Only the bottom portion 23 of the rear extending portion 80 is constituted by the oblique extending portion 70 in the second embodiment. A wire with terminal WT201 of this embodiment differs from the wire with terminal of the second embodiment in that a bottom portion 23 and a ceiling portion 24 of a rear extending portion 80 are respectively constituted by an oblique extending portion 70 in a wire connecting portion 220 of a terminal 201. Components corresponding to those of the second embodiment are denoted by reference signs obtained by adding 100 to the reference signs of the second embodiment. The same configuration, functions and effects as those of the second embodiment are not described and the same components as those of the second embodiment are denoted by the same reference signs.

According to this configuration, since a thickness of a water cut-off member 60 between the ceiling portion 24 of the rear extending portion 80 and an insulation coating 2C can be increased than in the first and second embodiments, the water cut-off effect on a back surface side of the wire connecting portion 220 can be further enhanced.

Fourth Embodiment

Figure 11:
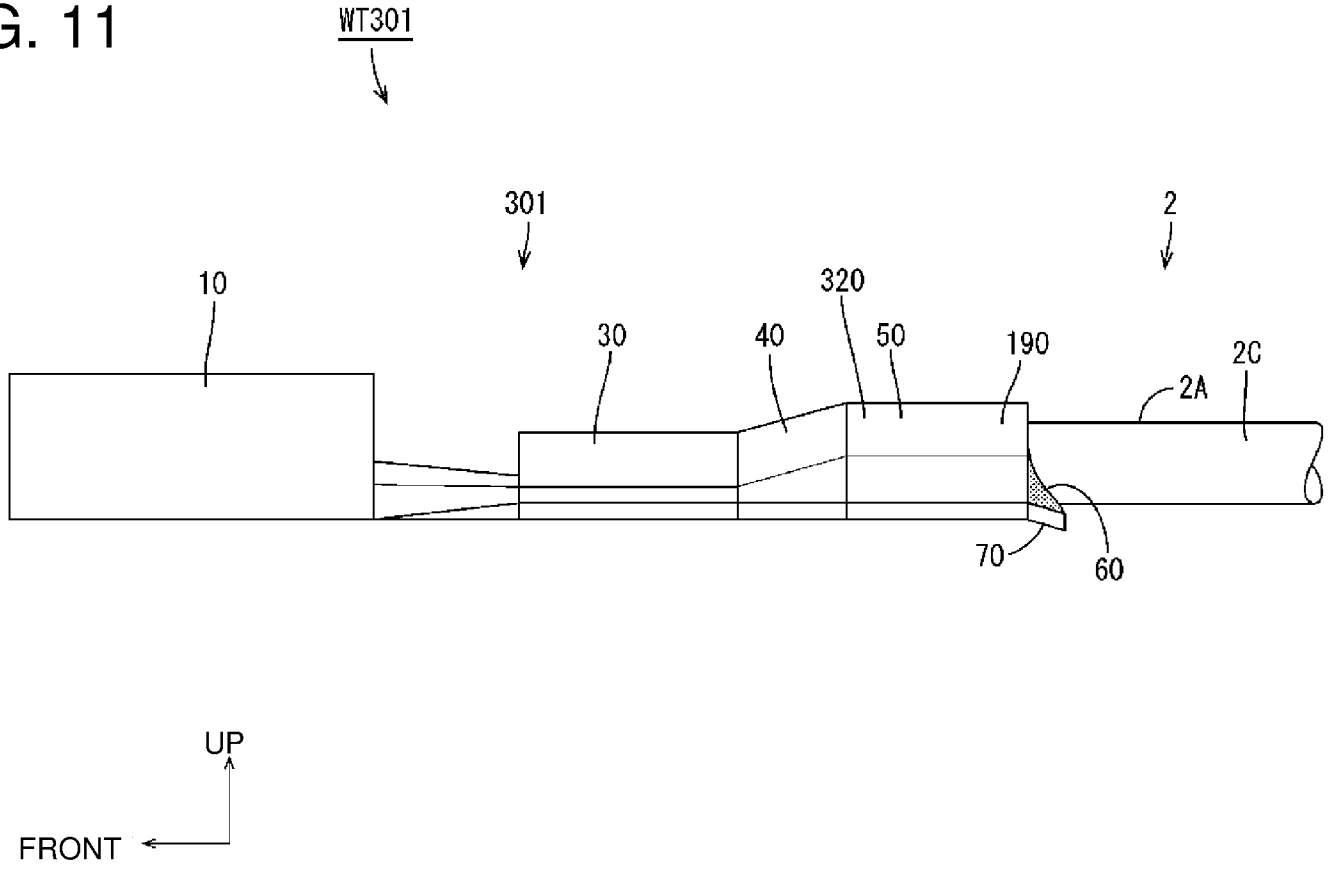
FIG. 11 is a side view showing a wire with terminal after crimping of a fourth embodiment.

Next, a fourth embodiment is described with reference to FIG. 11. The rear end part of the wire connecting portion 20 is constituted by the rear extending portion 80 and the bottom portion 23 of the rear extending portion 80 is constituted by the oblique extending portion 70 in the wire with terminal WT1 of the first embodiment. A wire with terminal WT301 of this embodiment differs from the wire with terminal of the first embodiment in that a rear end part of a wire connecting portion 320 of a terminal 301 is constituted by a parallel extending portion 190 connected behind a coating crimping portion 50 and a tab-shaped oblique extending portion 70 connected to the rear end of a bottom portion 23 of the parallel extending portion 190.

Components corresponding to those of the first embodiment are denoted by reference signs obtained by adding 300 to the reference signs of the first embodiment, and components corresponding to those of the second embodiment are denoted by reference signs obtained by adding 200 to the reference signs of the second embodiment. The same configuration, functions and effects as those of the first or second embodiment are not described and the same components as those of the first or second embodiment are denoted by the same reference signs.

In this embodiment, a water cut-off member pushed out rearward from the coating crimping portion 50 is annularly pushed out into the parallel extending portion 190. A part of the water cut-off member 60 that cannot be accommodated in the parallel extending portion 190 remains on the oblique extending portion 70 while being exposed to outside in a side view as shown in FIG. 11.

According to this configuration, since the oblique extending portion 70 can be formed only by bending a tab-shaped part projecting from the parallel extending portion 190 obliquely downward in a rear end part of the wire connecting portion 320, the oblique extending portion 70 can be easily formed.

Other Embodiments

The technique disclosed in this specification is not limited to the above described and illustrated embodiments and can be, for example, embodied as follows.

(1) Although the core crimping portion 30, the coupling portion 40 and the coating crimping portion 50 are coupled over the entire widths in the front-rear direction in the above embodiments, these may be connected in the front-rear direction only at the bottom portions. Further, each of the first and second barrel pieces may not include the coupling portion (i.e. the coupling portion may be constituted only by the bottom portion).

(2) Although the water cut-off member 60 is not stuck to the rear extending portion 80 before the wire connecting portion 20 is crimped to the wire 2 in the above embodiments, a water cut-off member may also be stuck to a rear extending portion before a wire connecting portion is crimped to a wire. In this case, in crimping the wire connecting portion to the wire, a clearance between the inner peripheral surface of the rear extending portion and the outer peripheral surface of an insulation coating is filled up by the water cut-off member pushed out from between a coating crimping portion and the insulation coating. Thus, the water cut-off effect on the back surface of the wire connecting portion can be further enhanced.

(3) Although only one oblique extending portion is formed on the bottom portion 23 in the rear end part of the wire connecting portion 20 in each of the above embodiments, the number of the oblique extending portions is not limited to this. For example, in the configuration of the first embodiment, the oblique extending portion formed on the bottom portion of the rear extending portion may be a first oblique extending portion and an oblique extending portion similar to the oblique extending portion of the fourth embodiment and provided on the rear end of the first oblique extending portion may be a second oblique extending portion. In this case, an angle of inclination with respect to the insulation coating and a dimension in the front-rear direction need not be equal between the first and second oblique extending portions and different angles and dimensions in the front-rear direction may be set according to desired water cut-off member holding performance.

(4) Although the wire connecting portion 20 is crimped to the wire 2 after the oblique extending portion 70 is formed in the above embodiments, a process sequence of the formation of an oblique extending portion and the crimping of a wire connecting portion to a wire is not limited to this. For example, the formation of the oblique extending portion and the crimping of the wire connecting portion to the wire may be simultaneously performed.

(5) Although the rear end of the oblique extending portion 70 has a horizontal flat shape in the above embodiments, the shape of the oblique extending portion 70 is not limited to this. For example, the oblique extending portion 70 may have a flat shape somewhat inclined toward one side or a substantially V shape when viewed from behind.

LIST OF REFERENCE SIGNS

1: terminal
2: wire
2A: outer peripheral surface
2B: core
2C: insulation coating
20A: inner peripheral surface
21: first barrel piece
22: second barrel piece
23: bottom portion
24: ceiling portion
50: coating crimping portion
60: water cut-off member
70: oblique extending portion
80: rear extending portion
190: parallel extending portion
WT1: wire with terminal

What is claimed is:

1. A wire with terminal, comprising:

a wire including a core and an insulation coating covering around the core; and a terminal including a coating crimping portion to be crimped to the insulation coating, an oblique extending portion provided in a rear end of the coating crimping portion, and a water cut-off member stuck to a portion of an upper surface of the coating crimping portion except for the oblique extending portion, wherein:

the insulation coating is pulled out rearward from the terminal, when the coating crimping portion is crimped to the insulation coating, the water cut-off member for suppressing liquid intrusion into the core is disposed between an inner peripheral surface of the coating crimping portion and an outer peripheral surface of the insulation coating, and the water cut-off member flowing rearward due to the crimping remains on the oblique extending portion.

2. The wire with terminal according to claim 1, wherein:

the coating crimping portion includes a bottom portion having the insulation coating placed thereon, a first barrel piece extending from one side end of the bottom portion and a second barrel piece extending longer than the first barrel piece from another side end of the bottom portion, and the inner peripheral surface of the coating crimping portion is closed over an entire circumference by the second barrel piece winding around the outer peripheral surface of the wire and the first barrel piece.

3. The wire with terminal according to claim 2, wherein:

the coating crimping portion includes a ceiling portion formed at a position facing the bottom portion via the wire by overlapping the first and second barrel pieces, and the oblique extending portion is provided behind the bottom portion.

4. The wire with terminal according to claim 1, wherein the oblique extending portion is inclined in a diameter expanding direction toward a rear side.

5. The wire with terminal according to claim 1, wherein:

the terminal further includes a rear extending portion connected to a rear end of the coating crimping portion over an entire circumference and configured to surround the insulation coating, and the oblique extending portion constitutes the rear extending portion.

6. The wire with terminal according to claim 5, further comprising a parallel extending portion connected to a rear end of the rear extending portion over an entire circumference, extending rearward and configured to surround the insulation coating, wherein:

a ceiling portion and a bottom portion of the parallel extending portion extend in parallel to the insulation coating.

7. The wire with terminal according to claim 1, wherein a rear end of the oblique extending portion is formed into a horizontal and substantially flat shape.

8. The wire with terminal according to claim 1, wherein, when the coating crimping portion is crimped to the insulation coating, a space is formed between the insulation coating and the oblique extending portion.

* * * * *